US006510841B1

(12) United States Patent
Stier

(10) Patent No.: US 6,510,841 B1
(45) Date of Patent: Jan. 28, 2003

(54) FUEL INJECTION VALVE

(75) Inventor: Hubert Stier, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/857,239

(22) PCT Filed: Oct. 5, 2000

(86) PCT No.: PCT/DE00/03496

§ 371 (c)(1),
(2), (4) Date: Jun. 1, 2001

(87) PCT Pub. No.: WO01/25614

PCT Pub. Date: Apr. 12, 2001

(30) Foreign Application Priority Data

Oct. 6, 1999 (DE) ..... 199 48 238

(51) Int. Cl.[7] ..... F02M 41/00
(52) U.S. Cl. ..... 123/472; 251/129.15; 239/585.3
(58) Field of Search ..... 123/472, 498, 123/497, 467; 239/584, 585.1, 585.5, 600, 585.3; 251/129.15

(56) References Cited

U.S. PATENT DOCUMENTS 4,311,280 A * 1/1982 Knape ..... 239/585
4,508,091 A * 4/1985 Wakeman ..... 123/586
5,118,077 A * 6/1992 Miller et al. ..... 251/129.15
5,706,778 A * 1/1998 Kapus ..... 123/276
5,979,786 A * 11/1999 Longman et al. ..... 239/5
6,047,718 A * 4/2000 Konsky et al. ..... 137/1
6,170,767 B1 * 1/2001 Herold et al. ..... 239/585.3

FOREIGN PATENT DOCUMENTS

| | | |
|---|---|---|
| EP | 0 692 624 | 1/1996 |
| WO | 97 02425 | 1/1997 |
| WO | 98 25025 | 6/1998 |
| WO | 99 23674 | 5/1999 |

* cited by examiner

*Primary Examiner*—Carl S. Miller
(74) *Attorney, Agent, or Firm*—Kenyon & Kenyon

(57) ABSTRACT

A fuel injector (1) for fuel injection systems of internal combustion engines is specially designed for the direct injection of fuel into the combustion chamber of an internal combustion engine. It is provided with a solenoid coil (10), a two-part armature (20*a*, 20*b*) that is acted upon through the solenoid coil (10) in a closing direction by a first resetting spring (23*a*), and a valve needle (3) that is connected to the larger armature part (20*a*) in a force-locking manner, for actuating a valve-closure member (4) which together with a valve seat surface (6) forms a sealing seat. The first armature part (20*a*) is acted upon in the closing direction by the first resetting spring (23*a*), and the second armature part (20*b*) is acted upon in the closing direction by the second resetting spring (23*b*), the spring constants of the resetting springs (23*a*, 23*b*) being different.

14 Claims, 3 Drawing Sheets

(STATE OF the Art)

FUEL INJECTION VALVE

BACKGROUND INFORMATION

Figure 1:
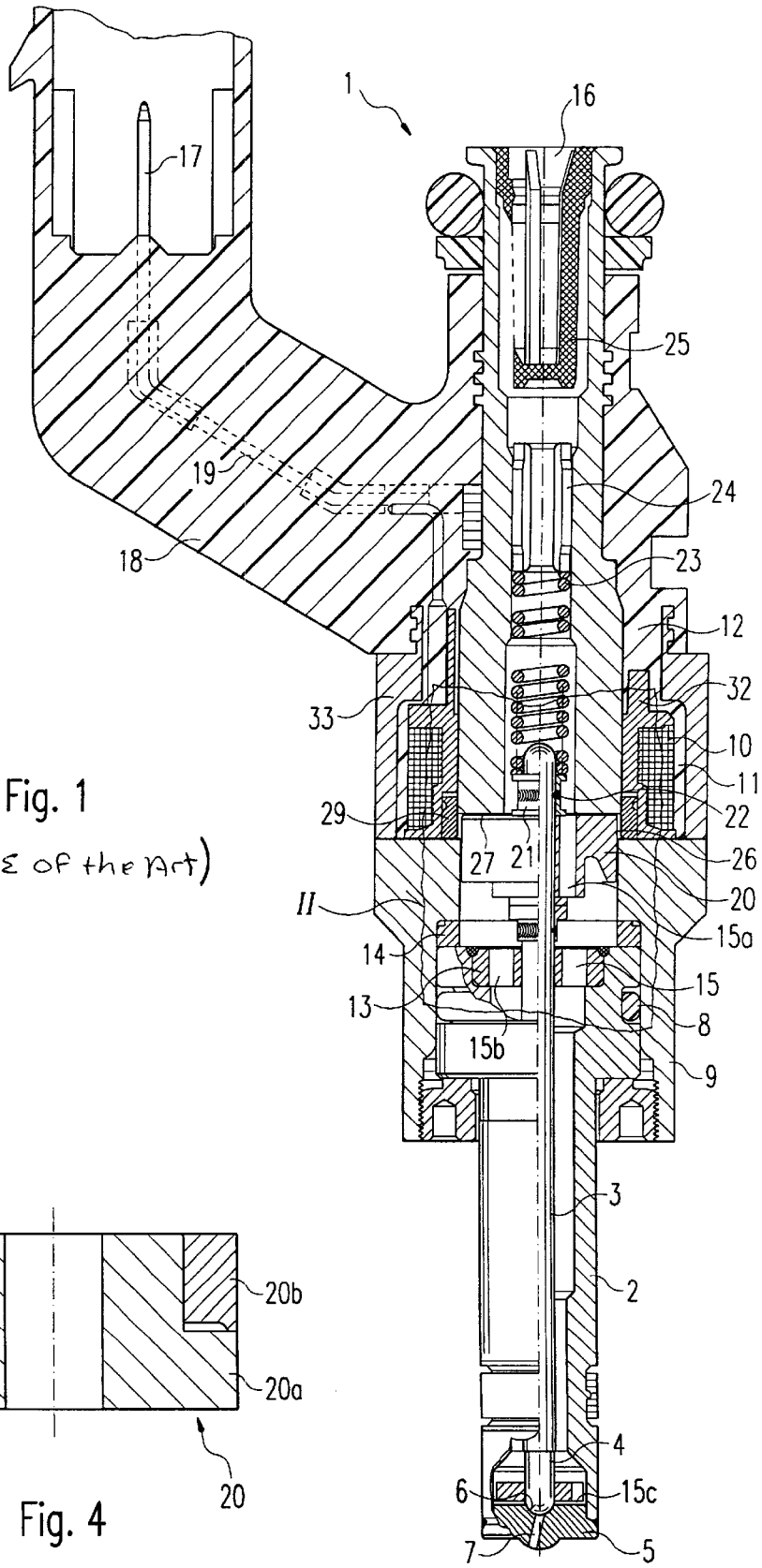

The present invention relates to a fuel injector according to the species of the main claim.

From German Patent 33 14 899 A1, an electromagnetically actuatable fuel injector is already known, in which, for the electromagnetic actuation, an armature cooperates with an electrically excitable solenoid coil, and the stroke of the armature is transmitted to a valve-closure member via a valve needle. The valve-closure member cooperates with a valve seat surface to form a sealing seat. The armature is not fixedly mounted on the valve needle, but is arranged thereon so as to be axially movable. A first resetting spring acts upon the valve needle in the closing direction and thus holds the fuel injector closed in the currentless, non-excited state of the solenoid coil. The armature is acted upon by a second resetting spring in the stroke direction such that the armature in the neutral position contacts a first limit stop provided on the valve needle. When the solenoid coil is excited, the armature is pulled in the stroke direction, carrying the valve needle along with it by the first limit stop. When the current exciting the solenoid coil is switched off, the valve needle is accelerated by the first resetting spring so as to move into its closing position, the valve needle carrying the armature along with it by the limit stop described above. As soon as the valve-closure member meets the valve seat, the closing motion of the valve needle is abruptly ended. The motion of the armature, which is not fixedly joined to the valve needle, continues in the stroke direction and is absorbed by the second resetting spring, i.e., the armature swings through against the second resetting spring, having essentially a smaller spring constant than the first resetting spring. Finally, the second resetting spring accelerates the armature once again in the stroke direction.

If the armature strikes the limit stop of the valve needle, this can lead to the valve-closure member, which is connected to the valve needle, lifting off once again for a short time from the valve seat, thus leading to a short-term opening of the fuel injector. Therefore, in the fuel injector known from German Patent 33 14 899 A1, the debouncing is imperfect. In addition, both in a conventional fuel injector, in which the armature is fixedly joined to the valve needle, as well as in the fuel injector known from German Patent 33 14 899 A1, it is disadvantageous that the opening stroke of the valve needle commences as soon as the magnetic force exerted by the solenoid coil on the armature exceeds the sum of the forces acting in the closing direction, i.e., the spring closing force exerted by the first resetting spring and the hydraulic forces of the fuel, which is under pressure. This is disadvantageous inasmuch as, when the current exciting the solenoid coil is switched on, the magnetic force, due to the self inductance of the solenoid coil and the eddy currents arising, has not yet reached its final value. Therefore, at the beginning of the opening stroke, the valve needle and the valve-closure member are accelerated at a reduced force. This leads to an opening time that is not satisfactory for all application cases.

In the closing motion, the known one-part armature sticks for a relatively long time to the magnetized internal pole and detaches itself due to the residual magnetization only after a relatively long time. This leads to relatively long closing times.

ADVANTAGES OF THE INVENTION

In contrast, the fuel injector according to the present invention having the features of the main claim has the advantage that the opening and closing times of the fuel injector attained by the two-part armature are reduced, thus resulting in a greater metering precision for the fuel. This is achieved by the armature detaching very rapidly from the internal pole, in comparison to a one-part armature. The resetting spring, having a large spring constant, directly contacts only one of the armature parts and has only to detach this part from the internal pole. Since the contact surface, which this armature part forms along with the internal pole, is significantly smaller than the entire contact surface, which the entire two-part armature forms along with the internal pole, this armature part detaches itself early from the internal pole, so that the closing motion begins early.

In addition, if the coordination of the mass ratio is good, the use of a two-part armature makes possible a debouncing of the system, in that, when the exciting current is switched off, the time difference between the acceleration of the larger armature part and that of the smaller armature part causes the two armature parts to strike each other in opposite directions. This leads to the elimination of the impulse of the slightly rebounding armature part, as a result of which an undesirable further short-term opening of the fuel injector is prevented.

Through the measures indicated in the subclaims, advantageous refinements and improvements of the fuel injector indicated in the main claim are possible.

Also advantageous is a slight, radial bevel or wedge-like shape of the armature end face that strikes the internal pole. As a result of a wedge-shaped surface configuration, the contact surface between the armature and the internal pole is reduced, and therefore the adhesive power acting between the armature and the internal pole is lessened. In this manner, when the magnetic field is reduced, the armature detaches itself more rapidly from the internal pole, as a result of which the valve closing time is shortened.

Especially advantageous is also the application of the prestroke principle. A prestroke gap between the larger armature part and the supporting flange makes possible a preacceleration of the two armature parts, as a result of which there is a starting impulse in the stroke direction. This is advantageous inasmuch as, when the current exciting the solenoid coil is switched on, the magnetic force, due to self inductance and eddy currents, has not yet reached its final value. However, the time that is gained by the prestroke is not sufficient to set up the magnetic field completely. Therefore, at the beginning of the opening stroke, the valve needle and the valve-closure member are accelerated at an unreduced force. This results in short and precise opening and metering times.

DRAWING

Figure 4:
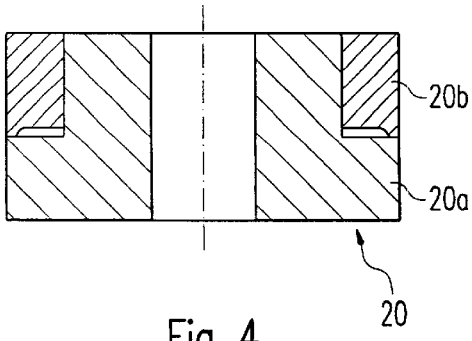
Figure 2:
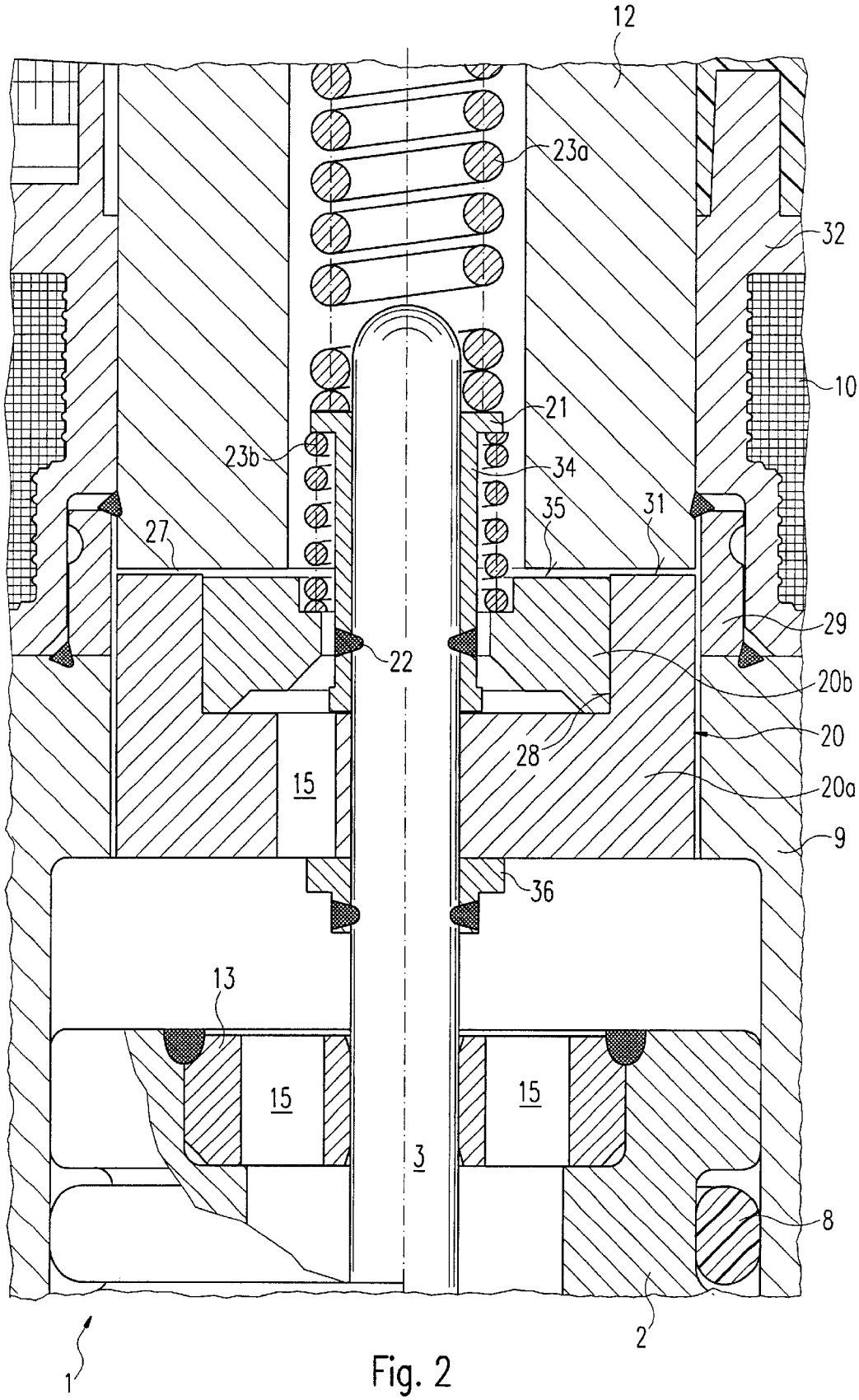
Figure 3:
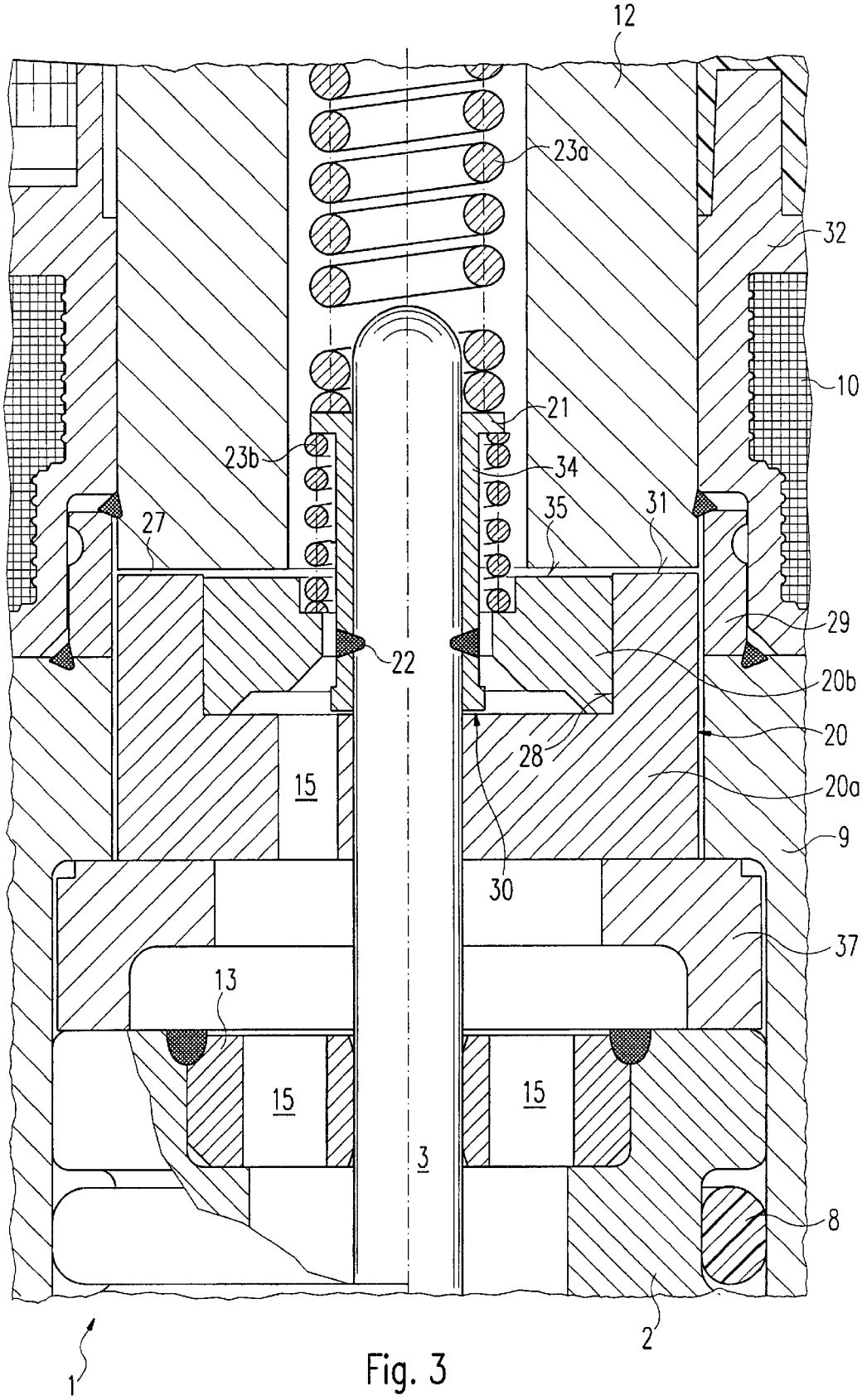

Exemplary embodiments of the present invention are depicted in simplified form in the drawing and are discussed in greater detail in the description below. The following are the contents:

FIG. 1 depicts an axial partial section of a fuel injector according to the related art, FIG. 2 depicts an enlarged segment of an axial section of a first exemplary embodiment of a fuel injector according to the present invention, in area II in FIG. 1, FIG. 3 depicts an enlarged segment of an axial section of a second exemplary embodiment of a fuel injector according to the present invention, in area II in FIG. 1, and FIG. 4 depicts an axial section of the armature of a fourth exemplary embodiment.

DESCRIPTION OF THE EXEMPLARY EMBODIMENTS

Before the three exemplary embodiments of a fuel injector according to the present invention are described in greater detail on the basis of FIGS. 2 through 4, an already known fuel injector will first be briefly discussed on the basis of FIG. 1 for the purpose of better comprehension of the present invention with respect to its essential components.

Fuel injector 1 is executed in the form of an injector for fuel injection systems of mixture-compressing, spark-ignition internal combustion engines. Fuel injector 1 is especially well suited for the direct injection of fuel into an undepicted combustion chamber of an internal combustion engine.

Fuel injector 1 is made up of a nozzle body 2, in which a valve needle 3 is guided. Valve needle 3 stands in an operative connection to a valve-closure member 4, which cooperates with a valve seat surface 6 arranged on a valve seat body 5, forming a sealing seat. Fuel injector 1 in the exemplary embodiment is a fuel injector 1 that opens to the inside, which is provided with a spray-discharge opening 7. Nozzle body 2 is sealed by a gasket seal 8 against an external pole 9 of a solenoid coil 10, partially forming a valve housing. Solenoid coil 10 is encapsulated in a coil housing 11 and is wound on a coil holder 32, which contacts an internal pole 12 of solenoid coil 10. Internal pole 12 and external pole 9 are separated from each other by a gap 26, both components 9 and 12 being connected to a non-magnetic connecting component 29. Solenoid coil 10 is excited via a line 19 by an electrical current that can be supplied through an electrical plug-in contact 17. Plug-in contact 17 is surrounded by a plastic casing 18, which can be injection-molded on internal pole 12. The magnetic flux circuit is closed by a reflux body 33.

Valve needle 3 is guided in a valve needle guideway 13, which is executed in a disk shape. A paired adjusting disk 14 is used for setting the stroke. Upstream of adjusting disk 14, an armature 20 is arranged on valve needle 3. The armature is connected in a force-locking manner via a supporting flange 21 to valve needle 3 at a welded seam 22. On supporting flange 21, a re-setting spring 23 is braced, which in the present configuration of fuel injector 1 is biased by an adjusting sleeve 24.

Running in valve needle guideway 13, in armature 20, and on valve seat body 5, are fuel channels 15*a*–15*c*, which guide the fuel to spray-discharge opening 7, the fuel being fed via a central fuel supply pipe 16 and being filtered by a filter element 25.

In the resting position of fuel injector 1, armature 20 is acted upon by resetting spring 23 contrary to its stroke direction, so that valve-closure member 4 is held in sealing contact on valve seat 6. When solenoid coil 10 is excited, it creates a magnetic field, which moves armature 20 in the stroke direction in opposition to the spring force of resetting spring 23, the stroke being prescribed by working gap 27, which, in the resting position, is situated between internal pole 12 and armature 20. Armature 20 also takes supporting flange 21 along with it in the stroke direction, the supporting flange being welded to valve needle 3. Valve-closure member 4, standing in an operative connection to valve needle 3, lifts off from valve seat surface 6, and fuel is conveyed past valve seat 6 to spray-discharge opening 7.

If the coil current is switched off, armature 20, after a sufficient decline in the magnetic field, falls off from internal pole 12 due to the pressure of resetting spring 23, as a result of which valve needle 3 moves contrary to the stroke direction. As a consequence, valve-closure member 4 is placed on valve seat surface 6, and fuel injector 1 is closed.

In a partial axial sectional view, FIG. 2 depicts a first exemplary embodiment of the configuration of fuel injector 1 according to the present invention. In the enlarged depiction, only those components are indicated that are of essential importance with respect to the present invention. The configuration of the remaining components can be identical to a known fuel injector 1, in particular, fuel injector 1 depicted in FIG. 1. Elements already described are provided with corresponding reference numerals, so that a repeat description is made unnecessary.

Armature 20, which is executed in one part in FIG. 1, is subdivided according to the invention into a first, larger armature part 20*a* and a second, smaller armature part 20*b*. Smaller armature part 20*b* is arranged in a central cutout 28 of larger armature part 20*a*. Larger armature part 20*a* is acted upon by a first, stronger resetting spring 23*a*, and smaller armature part 20*b* by a second, weaker resetting spring 23*b*. Resetting spring 23*a* is supported on supporting flange 21 of an, e.g., sleeve-shaped mounting part 34, whereas resetting spring 23*b* is gripped between supporting flange 21 and armature part 20*b*. A flange 36, which is welded in a force-locking manner to valve needle 3, is used as the lower armature limit stop, which catches larger armature part 20*a*, after it has detached itself from internal pole 12.

If an exciting current is applied to solenoid coil 10 via plug-in contact 17 and line 19, a magnetic field is created, which simultaneously accelerates first armature part 20*a* and second armature part 20*b* and pulls them to internal pole 12. To this extent, the mode of operating of two-part armature 20*a*, 20*b* according to the present invention is not different from that of armature 20, which is executed as a single part.

If the exciting current is switched off, the magnetic field dissipates, such that larger armature part 20*a*, acted upon by first, stronger resetting spring 23*a*, detaches itself from internal pole 12 and is accelerated in the closing direction. As a result of smaller end face 31 of armature part 20*a*, in comparison to a one-part armature 20, armature part 20*a* detaches itself from internal pole 12 already after a significantly shorter time than a one-part armature 20, since the magnetic flux is proportional to the surface and declines exponentially with respect to time.

This effect can be even further amplified by a slight beveling of end faces 31 and 35 of armature 20. As a result of a bevel even in the order of magnitude of a few $\mu$m, the adhesive powers between internal pole 12 and end face 31 of larger armature part 20*a*, as well as of end face 35 of smaller armature part 20*b*, are reduced to a fraction, which promotes a further shortening of the closing time. Smaller armature part 20*b*, which is acted upon by second, weaker resetting spring 23*b*, remains some further time at internal pole 12 and therefore does not hinder the rapid closing process of fuel injector 1. If the bevel of end faces 31 and 35 is selected so that end face 31 of larger armature part 20*a* is more steeply angled than end face 35 of smaller armature part 20*b*, then, on the one hand, the adhesive power of both armature parts 20*a*, 20*b* is reduced at internal pole 12, i.e., larger armature part 20*a* can therefore detach itself fundamentally more rapidly from internal pole 12, and, on the other hand, the adhesive power is somewhat less weakened as a result of the lesser bevel of end face 35 of the smaller armature part, and smaller armature part 20*b* nevertheless falls off from internal pole 12 in a delayed manner after larger armature part 20*a*. As a result of the two-part form of armature 20, a significantly shorter closing time and therefore a shorter metering time is achieved, along with a more precise metering quantity for the fuel.

The rebound effect of a two-part armature 20 is also improved in comparison to a one-part armature 20. This is achieved, first, by the reduced mass of each of two armature parts 20*a* and 20*b*, because a smaller armature mass rebounds less strongly. In addition, by choosing the mass ratio of armature parts 20*a* and 20*b* correctly, it can be achieved that smaller armature part 20*b* falls away from internal pole 12, such that it approaches armature part 20*a*, which has previously fallen away and is being propelled by flange 36 which is used as the lower armature limit stop, and the impulses in the opposite direction are virtually eliminated, which prevents an undesirable further short-term opening of fuel injector 1 as a result of rebounding larger armature part 20*a*. A further short-term opening of fuel injector 1 is also prevented by the fixed connection of flange 36 to valve needle 3, because armature part 20*a* meets flange 36 in the closing direction and rather increases than reduces the pressure on valve-closure member 4.

In a partial, axial sectional view, FIG. 3 depicts a second exemplary embodiment of the configuration of fuel injector 1 according to the present invention. Elements already described are provided with corresponding reference numerals, so that a repeat description is made unnecessary.

In comparison to FIG. 2, fuel injector 1 in this version has also a prestroke gap 30, situated between larger armature part 20*a* and supporting flange 21, the prestroke gap making possible a preacceleration of both armature parts 20*a*, 20*b*. In this manner, when armature part 20*a* meets supporting flange 21, there is already an impulse present in the stroke direction, which is transmitted via supporting flange 21 to valve needle 3 and which acts in a positive way on the opening times of fuel injector 1. This is advantageous inasmuch as, when the current exciting solenoid coil 10 is switched on, the magnetic force, due to the self inductance of solenoid coil 10 and to eddy currents that arise, has not yet reached its final value. However, the time that elapses until armature part 20*a* reaches the limit stop on supporting flange 21 is not sufficient to set up the magnetic field completely. Valve needle 3 and valve-closure member 4, at the beginning of the opening stroke, are accelerated at an unreduced force. This results in short and precise opening and metering times.

The lower armature limit stop, which in the first exemplary embodiment is executed as flange 36 and is fixedly joined to valve needle 3 is configured in the second exemplary embodiment as ring 37 and is located upstream of nozzle body 2. The housing-fixed placement of ring 37 is even more advantageous than flange 36, which is connected to valve needle 3, because valve needle 3 can now swing freely in response to the rebounding of larger armature part 20*a*, and no further impulse can be transmitted to the valve needle.

FIG. 4 depicts an axial section of armature 20 of a third exemplary embodiment of a fuel injector 1 according to the present invention. Larger, first armature part 20*a* is enclosed in an, annular fashion by smaller, second armature part 20*b*. In this context, in this exemplary embodiment, first armature part 20*a* strikes against internal pole 12 on the inside and second armature part 20*b* strikes against internal pole 12 on the outside.

The present invention is not limited to the exemplary embodiments depicted and can be also realized in a multiplicity of other types of construction of fuel injectors. For example, second resetting spring 23*b* can also be supported on internal pole 12 or on a housing component.

What is claimed is:

1. A fuel injector for a fuel injection system of an internal combustion engine, comprising:

a solenoid coil;

a valve-closure member;

a valve seat surface, the valve-closure member and the valve seat surface together forming a sealing seat;

an armature subdivided into a first armature part and a second armature part;

a valve needle connected in a force-locking manner to the armature, for actuating the valve-closure member;

a first resetting spring for acting upon the first armature part in a closing direction through the solenoid coil, the first resetting spring having a first spring force; and a second resetting spring for acting upon the second armature part in the closing direction, the second resetting spring having a second spring force smaller than the first spring force; wherein, in response to a switching off of an exciting current, the first armature part accelerates in the closing direction before the second armature part.

2. The fuel injector according to claim 1, wherein the fuel injector is for a direct injection of fuel into a combustion chamber of the engine.

3. The fuel injector according to claim 1, wherein the first armature part has a central cutout in which the second armature part is guided.

4. The fuel injector according to claim 3, further comprising a support flange fixedly joined to the valve needle, the first armature part being connected in a force-locking manner to the supporting flange.

5. A fuel injector for a fuel injection system of an internal combustion engine, comprising:

a solenoid coil;

a valve-closure member;

a valve seat surface, the valve-closure member and the valve seat surface together forming a sealing seat;

an armature subdivided into a first armature part and a second armature part;

a valve needle connected in a force-locking manner to the armature, for actuating the valve-closure member;

a first resetting spring for acting upon the first armature part in a closing direction through the solenoid coil, the first resetting spring having a first spring force;

a second resetting spring for acting upon the second armature part in the closing direction, the second resetting spring having a second spring force different from the first spring force;

a supporting flange fixedly joined to the valve needle, the first armature part being connected in a force-locking manner to the supporting flange; and a sleeve-shaped mounting part on which the supporting flange is situated, the valve needle extending through a central cutout of the supporting flange.

6. A fuel injector for a fuel injection system of an internal combustion engine, comprising:

a solenoid coil;

a valve-closure member;

a valve seat surface, the valve-closure member and the valve seat surface together forming a sealing seat;

an armature subdivided into a first armature part and a second armature part;

a valve needle connected in a force-locking manner to the armature, for actuating the valve-closure member;

a first resetting spring for acting upon the first armature part in a closing direction through the solenoid coil, the first resetting spring having a first spring force;

a second resetting spring for acting upon the second armature part in the closing direction, the second resetting spring having a second spring force different from the first spring force; and a supporting flange fixedly joined to the valve needle, the first armature part being connected in a force-locking manner to the supporting flange; wherein the first resetting spring acts upon the first armature part via the supporting flange on the valve needle.

7. A fuel injector for a fuel injection system of an internal combustion engine, comprising:

a solenoid coil;

a valve-closure member;

a valve seat surface, the valve-closure member and the valve seat surface together forming a sealing seat;

an armature subdivided into a first armature part and a second armature part;

a valve needle connected in a force-locking manner to the armature, for actuating the valve-closure member;

a first resetting spring for acting upon the first armature part in a closing direction through the solenoid coil, the first resetting spring having a first spring force;

a second resetting spring for acting upon the second armature part in the closing direction, the second resetting spring having a second spring force different from the first spring force; and a supporting flange fixedly joined to the valve needle, the first armature part being connected in a force-locking manner to the supporting flange; wherein the second armature part is connected in a force-locking manner to the supporting flange via the second resetting spring.

8. The fuel injector according to claim 1, further comprising an internal pole, wherein, when the solenoid coil is excited, the first and second armature parts jointly move towards the internal pole in a direction opposite to a closing direction.

9. The fuel injector according to claim 8, wherein, when the solenoid coil is switched off, the first armature part detaches itself from the internal pole by the first spring force and, independent of the second armature part, moves back into a starting position.

10. The fuel injector according to claim 9, wherein the second resetting spring moves back the second armature part into the starting position, after a further reduction of a magnetic field.

11. The fuel injector according to claim 8, wherein the first armature part has an end face facing the internal pole, the end face having a bevel.

12. The fuel injector according to claim 8, wherein the first armature part has a beveled end face, the second armature part has a beveled end face facing the internal pole, and a bevel of the end face of the first armature part is greater than a bevel of the end face of the second armature part.

13. A fuel injector for a fuel injection system of an internal combustion engine, comprising:

a solenoid coil;

a valve-closure member;

a valve seat surface, the valve-closure member and the valve seat surface together forming a sealing seat;

an armature subdivided into a first armature part and a second armature part;

a valve needle connected in a force-locking manner to the armature, for actuating the valve-closure member;

a first resetting spring for acting upon the first armature part in a closing direction through the solenoid coil, the first resetting spring having a first spring force;

a second resetting spring for acting upon the second armature part in the closing direction, the second resetting spring having a second spring force different from the first spring force; and a supporting flange fixedly joined to the valve needle, the first armature part being connected in a force-locking manner to the supporting flange; wherein a prestroke gap is defined between the supporting flange and the first armature part, the prestroke gap allowing a preacceleration of the first armature part before the first armature part acts via the supporting flange upon the valve needle.

14. The fuel injector according to claim 1, wherein a mass ratio between the first armature part and the second armature part is suitably selected to permit a debouncing of the fuel injector.

* * * * *

UNITED STATES PATENT AND TRADEMARK OFFICE

CERTIFICATE OF CORRECTION

PATENT NO. : 6,510,841 B1
DATED : January 28, 2003
INVENTOR(S) : Hubert Stier

It is certified that error appears in the above-identified patent and that said Letters Patent is hereby corrected as shown below:

Title page,
Item [57], ABSTRACT,
delete "(1), (10), (20a, 20b), (10), (23a), (3), (20a), (4), (6), (20a), (23a),(20b), (23b), (23a, 23b)"

Column 1,
Line 4, delete "The present invention relates to a fuel injector according"
Line 5, delete "to the species of the main claim."
Line 6, change "From German Patent 3314899A1" to -- German Patent 3314899 describes --
Line 7, delete "is already known"
Line 41, change "known from" to -- described in --
Line 41, change "Patent 33" to -- Patent No. 33 --
Line 44, change "Known from" to -- described in --
Line 44, change "Patent 33" to -- Patent No. 33 --
Line 65, change "ADVANTAGES OF" to -- SUMMARY OF --
Line 66, change "In contrast, the fuel" to -- The fuel --
Line 67, delete "having the features of the main claim"

Column 2,
Line 24, delete "Through the measures indicated in the subclaims, advan-"
Line 25, delete "tageous refinements and improvements of the fuel injector"
Line 26, delete "indicated n the main claim are possible."
Line 53, change "DRAWING" to -- BRIEF DESCRIPTION OF THE DRAWINGS --
Line 54, delete "Exemplary embodiments of the present invention are"
Line 55, delete "depicted in simplified form in the drawing and are discussed"
Line 56, delete "in greater detail in the description below. The follow are"
Line 57, delete "the contents:"
Line 59, change "related art," to -- related art. --
Line 62, change "FIG. 1" to -- FIG 1. --
Line 65, change "FIG. 1" to -- FIG 1. --

UNITED STATES PATENT AND TRADEMARK OFFICE

CERTIFICATE OF CORRECTION

PATENT NO. : 6,510,841 B1
DATED : January 28, 2003
INVENTOR(S) : Hubert Stier

It is certified that error appears in the above-identified patent and that said Letters Patent is hereby corrected as shown below:

Column 3,
Line 8, change “essential” to -- important --
Line 26, change “coil holder” to -- coil (spool) holder --

Column 4,
Line 15, change “to the inventor” to -- to the present invention --
Line 22, change “of an, e.g.” to -- of a , e.g. --

Signed and Sealed this

Twenty-fourth Day of August, 2004

JON W. DUDAS
*Director of the United States Patent and Trademark Office*